US006257103B1

(12) United States Patent
Yu

(10) Patent No.: US 6,257,103 B1
(45) Date of Patent: Jul. 10, 2001

(54) FOLDABLE TIRE WRENCH ASSEMBLY

(76) Inventor: Hsiu-E Yu, No. 921-11, Chung Shan Road, Section 2, Ta-Chia, Taichung Hsein (TW)

( * ) Notice: Subject to any disclaimer, the term of this patent is extended or adjusted under 35 U.S.C. 154(b) by 0 days.

(21) Appl. No.: 09/525,673

(22) Filed: Mar. 15, 2000

(51) Int. Cl.[7] ..... B25B 23/16

(52) U.S. Cl. ..... 81/177.6; 81/124.5; 81/125.1; 81/177.7

(58) Field of Search ..... 81/177.6, 177.9, 81/177.8, 177.7, 124.4, 124.5, 125.1

(56) References Cited

U.S. PATENT DOCUMENTS 2,738,694 * 3/1956 Boatright ..... 81/177.6 X
3,587,366 * 6/1971 Klein ..... 81/177.6 X
3,742,790 * 7/1973 Galley ..... 81/177.6 X
4,236,266 * 12/1980 Hannah et al. ..... 81/177.6 X
4,505,171 * 3/1985 Chang ..... 81/177.6 X

* cited by examiner

*Primary Examiner*—D. S. Meislin
(74) *Attorney, Agent, or Firm*—Alan Kamrath; Rider Bennett Egan & Arundel

(57) ABSTRACT

A wrench assembly includes two arms pivoted at the middle by a connection device. The connection device includes a bolt extending through two cross-bores in the two arms and a stem is biased received in a recess in the bolt. A button connected to the stem and has a rod extending perpendicularly therefrom. The first arm has a hole and the second arm has a concavity which is in alignment with the hole. A block and a spring are received in the concavity. The rod extends through the hole and compresses the block. When the block is located between the first arm and the second arm, the two arms are not pivoted with each other. When the block is pushed into the concavity by pushing the button, the two arms can be pivoted about the bolt.

5 Claims, 6 Drawing Sheets

FOLDABLE TIRE WRENCH ASSEMBLY

FIELD OF THE INVENTION

The present invention relates to a foldable wrench assembly comprising two arms each have two sockets on two ends thereof, the two arms pivotably connected with each other at a middle by a push-type connection means which allows the two arms folded toward with each other.

BACKGROUND OF THE INVENTION

A conventional foldable wrench assembly known to applicant is disclosed in U.S. Pat. No. 3,742,790 to Galley, with a title of "Wheel Braces". The wheel braces includes two arms pivoted together at the middle by a thumbscrew, and a nut is engaged with the thumbscrew from opposite side of the braces. Lateral projections are respectively connected to the middle of the two arms and each projection has a concave surface for embracing the arms respectively. When in use, the user unscrews the thumbscrew and pivots the two arms to a desired position and then tightens the thumbscrew again. It is not convenient for the user to unfold the assembly because the user has to rotate the thumbscrew, the rotation action takes time. Besides, when unscrewing the thumbscrew, the user has to hold the nut so as not to let the thumbscrew separate from the nut.

The present invention intends to provide a wrench assembly that has a push-type connection means connecting the two arms at the middle and the two arm can be quickly pivoted by simply pushing a button of the connection means.

SUMMARY OF THE INVENTION

In accordance with one aspect of the present invention, there is provided a wrench assembly and comprising a first arm pivotably connected to a second arm at the middle by a connection means. The first arm has a first cross-bore defined through the middle thereof and a flange extends radially inward from an inside of the first cross-bore. A hole is defined through the flange. The second arm has a second cross-bore defined through the middle thereof and a concavity is defined beside the second cross-bore. A spring is received in the concavity and a block is biased by the spring and movably between the hole and the concavity. A bolt extends through the first cross-bore, the second cross-bore and is engaged with a nut. The bolt has a recess defined centrally and longitudinally therethrough so as to receive a stem and a spring. A button is connected to the stem and a rod extends perpendicularly from the button. The rod extends through the hole in the first arm and contacts the block.

The object of the present invention is to provide a wrench assembly that is pivotably connected together by a push-type connection means so that the user simply pushes the button of the connection means can pivot the two arms of the wrench assembly.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
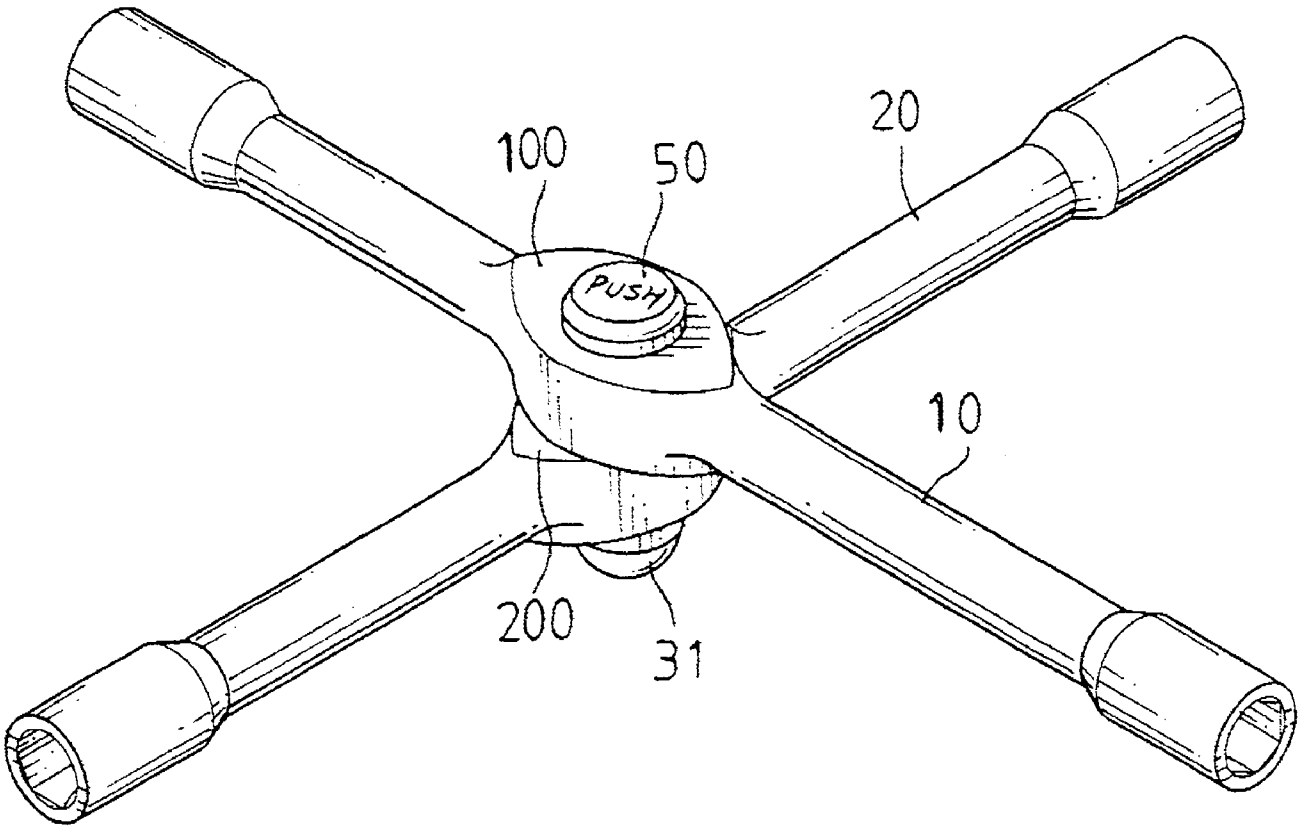
FIG. 1 is a perspective view to show the wrench assembly of the present invention in operative relation.
Figure 2:
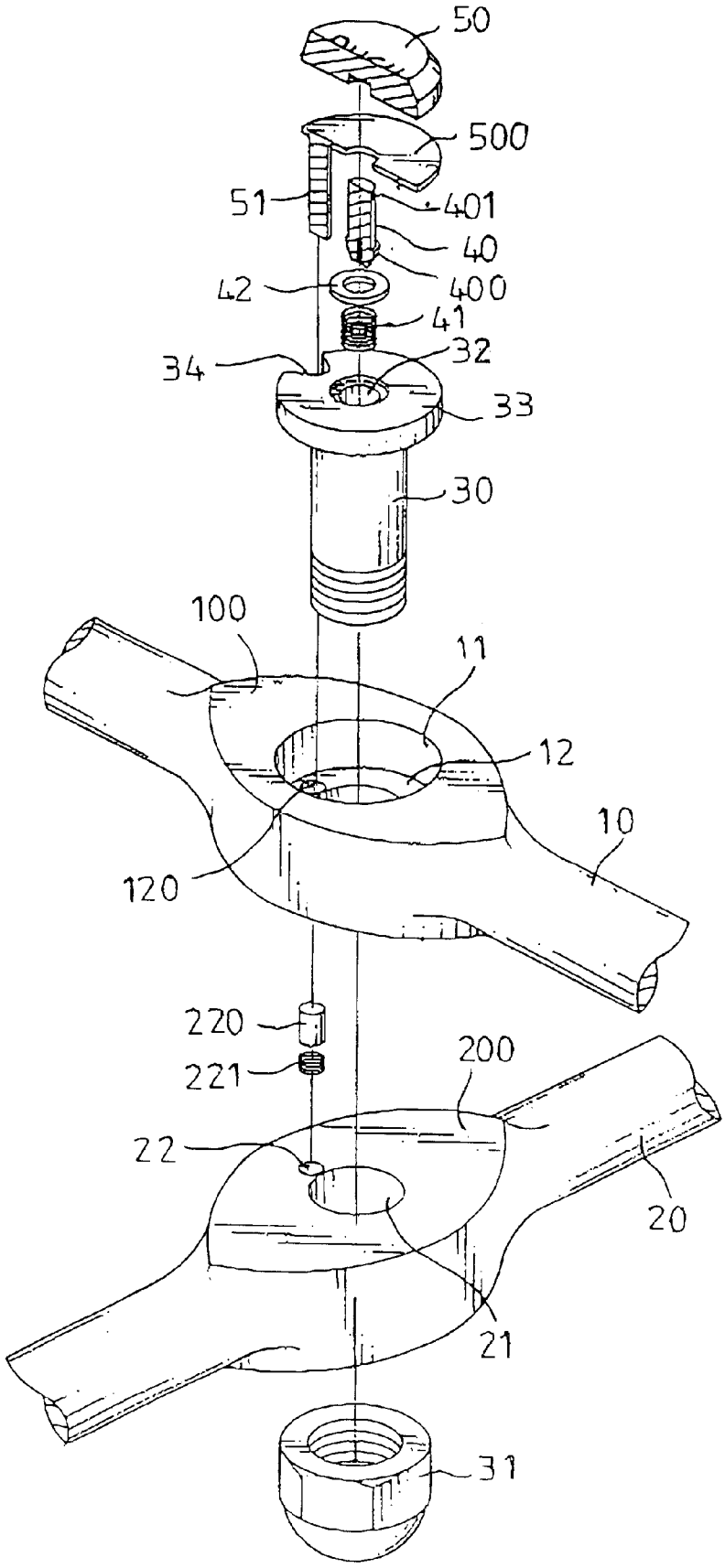
FIG. 2 is an exploded view to show the wrench assembly of the present invention.
Figure 3:
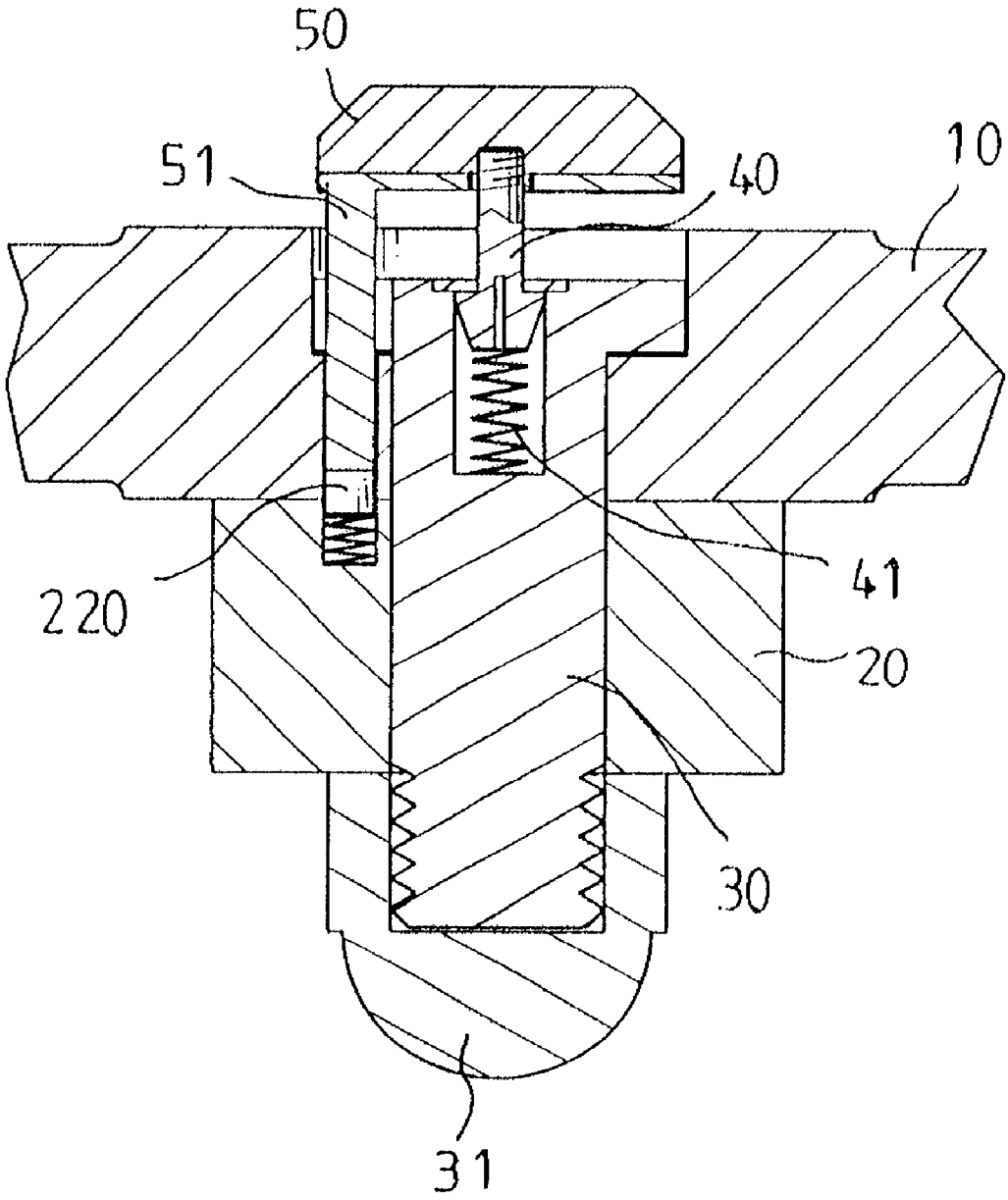
FIG. 3 is a side elevational view, partly in section, of the connection means of the present invention when the button of the connection means is not yet pushed.

Referring to FIGS. 1 to 3, the wrench assembly in accordance with the present invention comprises a first arm 10 and a second arm 20. Each end of the first arm 10 and the second arm 20 having a tool connected thereto such has a socket. Two flat surfaces 100 are defined in opposite on an outside of the middle of the first arm 10 and a first cross-bore 11 is defined through the middle of the first arm 10. A flange 12 extends radially inward from an inside of the first cross-bore 11 and a hole 120 is defined through the flange 12. The second arm 20 has two flat surfaces 200 defined in opposite on an outside of the middle of the second arm 20 and a second cross-bore 21 is defined through the middle of the second arm 20. A concavity 22 is defined beside the second cross-bore 21 in the second arm 20. A spring 221 is received in the concavity 22 and a block 220 is biased by the spring 221 and movable between the hole 120 and the concavity 22 when the concavity 22 is located in alignment with the hole 120.

The first arm 10 and the second arm 20 are pivoted together by a connection means which includes a bolt 30 extending through the first cross-bore 11, the second cross-bore 21 and engaged with a nut 31. The bolt 30 has a recess 32 defined centrally and longitudinally therethrough for receiving a stem 40 and a spring 41 received therein. The stem 40 has an enlarged head 400 and a washer 42 is mounted to the stem 40, the washer 42 fixedly engaged with the recess 32 in the bolt 30 so that the stem 40 will not removed from the recess 32. The stem 40 has a threaded outside 401 which is threadedly connected to the button 50. A disk 500 is connected to an underside of the button 50 and a rod 51 extends perpendicularly from the disk 500. A top flange 33 extends radially outward from a top of the bolt 30 and a notch 34 is defined in the top flange 33. The rod 51 extends through the notch 34, the hole 120 in the first arm 10 and contacts the block 220.

Figure 4:
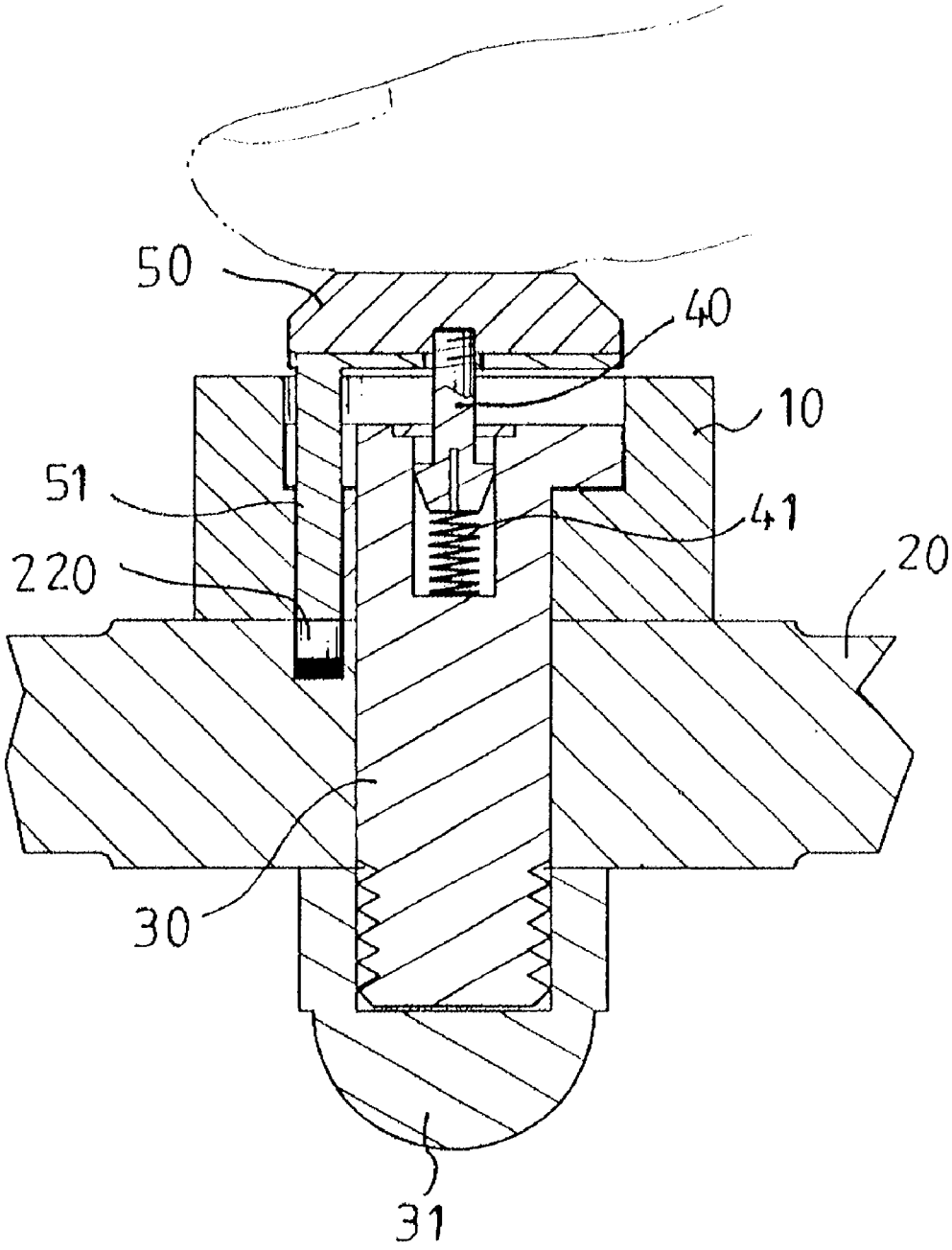
FIG. 4 is a side elevational view, partly in section, of the connection means of the present invention when the button of the connection means is pushed.
Figure 5:
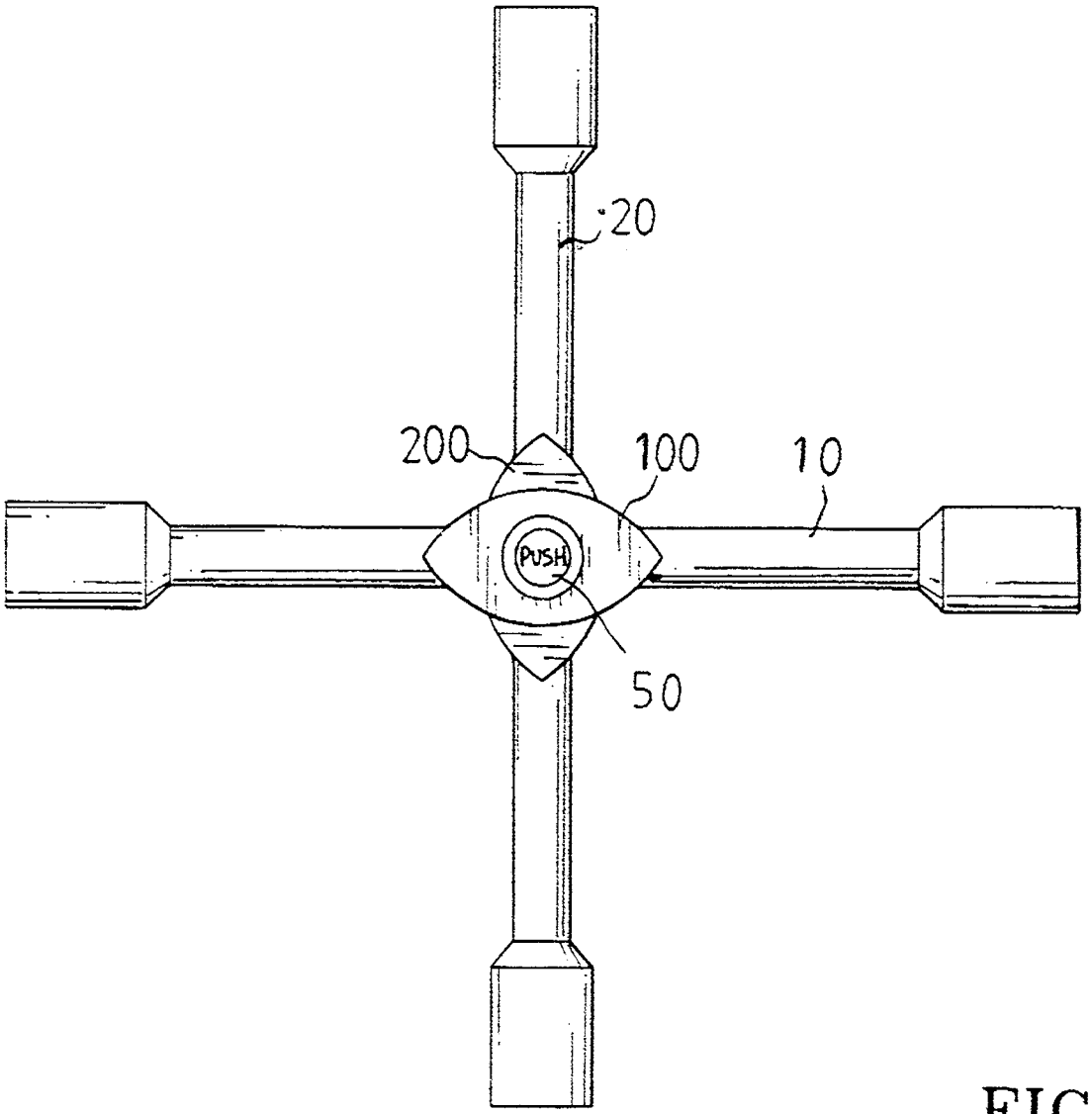
FIG. 5 is a plan view to show the wrench assembly of the present invention in operative relation.
Figure 6:
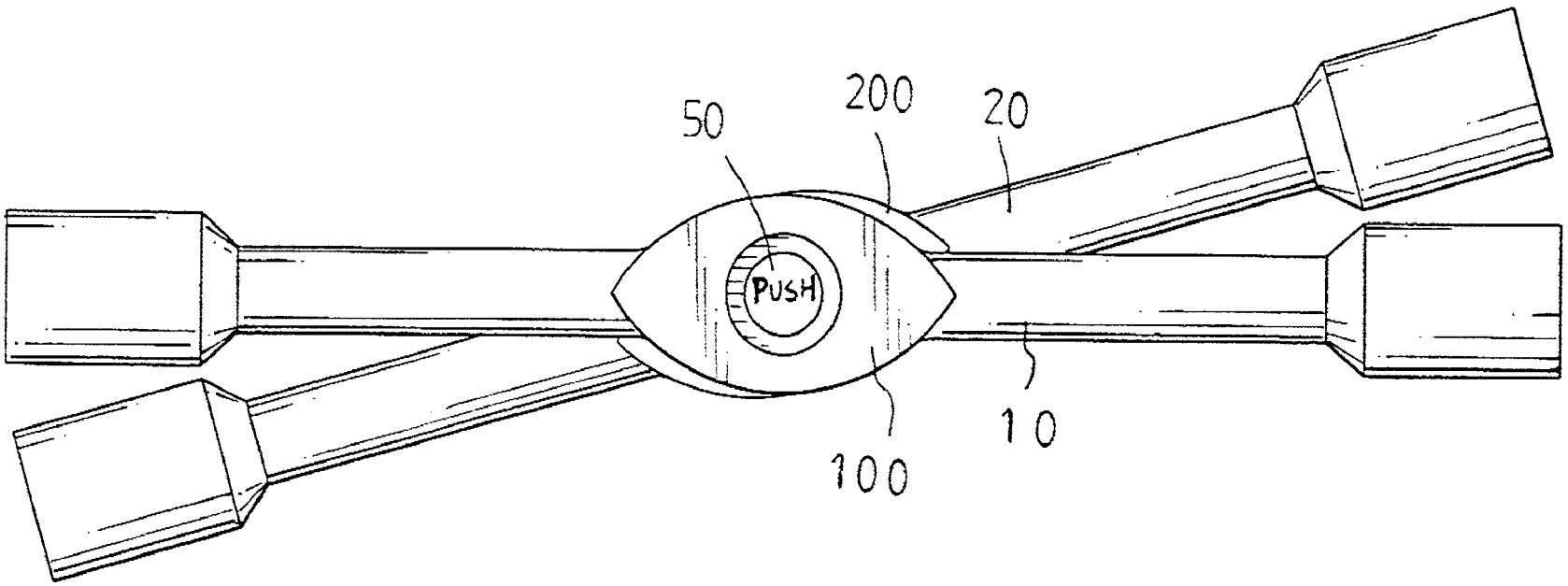
FIG. 6 is a plan view to show the wrench assembly of the present invention in folded relation.

As shown in FIG. 4, when pushing the button 50 toward the bolt 30, the rod 51 is lowered and the spring 41 is compressed by the stem 40. The rod 51 pushes the block 220 into the concavity 22 so that the first arm 10 and the second arm 20 can be pivoted about the bolt 30 to an operative position as shown in FIG. 5 or a folded position as shown in FIG. 6. In the operation position, the block 220 is located as a bridge between the concavity 22 and the hole 120, so that the first arm 10 cannot pivoted relative to the second arm 20.

The wrench assembly is convenient to be operated by pushing the button 50. This action can be done by a thumb of the user while the hand still holds the wrench assembly.

While we have shown and described various embodiments in accordance with the present invention, it should be clear to those skilled in the art that further embodiments may be made without departing from the scope and spirit of the present invention.

What is claimed is:

1. A wrench assembly comprising:

a first arm and a second arm, each end of said first arm and said second arm having a tool connected thereto, said first arm having a first cross-bore defined through a middle thereof and a flange extending radially inward from an inside of said first cross-bore, a hole defined through said flange, said second arm having a second cross-bore defined through a middle thereof and a concavity defined beside said second cross-bore in said second arm, a spring received in said concavity and a block located in said concavity and biased by said spring;

a bolt extending through said first cross-bore, said second cross-bore and engaged with a nut, said bolt having a recess defined centrally and longitudinally therethrough, a stem and a spring respectively received in said recess, and a button connected to said stem and a rod extending perpendicularly from said button, said rod extending through said hole in said first arm and contacting said block.

2. The assembly as claimed in claim 1 further comprising two flat surfaces defined in opposite on an outside of said middle of said first arm, two flat surfaces defined in opposite on an outside of said middle of said second arm.

3. The assembly as claimed in claim 1, wherein said stem has an enlarged head and a washer mounted to said stem, said washer fixedly engaged with said recess in said bolt.

4. The assembly as claimed in claim 1, wherein said stem has a threaded outside which is threadedly connected to said button.

5. The assembly as claimed in claim 1 further comprising a top flange extending radially outward from a top of said bolt, a notch defined in said top flange and said rod extending through said notch.

* * * * *